US007134851B2

(12) United States Patent
Chenoweth

(10) Patent No.: US 7,134,851 B2
(45) Date of Patent: Nov. 14, 2006

(54) RECIPROCATING PUMP HAVING A CERAMIC PISTON

(75) Inventor: J. Mark Chenoweth, Arvada, CO (US)

(73) Assignee: CoorsTek, Inc., Golden, CO (US)

( * ) Notice: Subject to any disclaimer, the term of this patent is extended or adjusted under 35 U.S.C. 154(b) by 229 days.

(21) Appl. No.: 10/422,059

(22) Filed: Apr. 22, 2003

(65) Prior Publication Data

US 2004/0213690 A1 Oct. 28, 2004

(51) Int. Cl.
*F04B 53/10* (2006.01)

(52) U.S. Cl. ..... 417/571; 417/DIG. 1

(58) Field of Classification Search ..... 417/415, 417/DIG. 1, 571

See application file for complete search history.

(56) References Cited

U.S. PATENT DOCUMENTS

| | | | | | |
|---|---|---|---|---|---|
| 2,938,381 | A | | 5/1960 | Smith et al. | |
| 3,093,122 | A | | 6/1963 | Sachnik | |
| 3,495,544 | A | * | 2/1970 | Enssle | 417/307 |
| 3,740,171 | A | * | 6/1973 | Farkos | 417/418 |
| 3,966,360 | A | * | 6/1976 | Greene | 417/53 |
| 4,516,479 | A | * | 5/1985 | Vadasz | 92/170.1 |
| 5,033,940 | A | * | 7/1991 | Baumann | 417/273 |
| 5,403,169 | A | * | 4/1995 | Yokoi et al. | 417/568 |
| 5,494,420 | A | * | 2/1996 | Mawhirt et al. | 417/500 |
| 6,149,073 | A | * | 11/2000 | Hickey et al. | 239/89 |
| 6,510,781 | B1 | | 1/2003 | Pecca et al. | |

OTHER PUBLICATIONS

Medical Devicelink website: *North American Suppliers Directory Index: CoorsTek*, 2002, Canon Communications LLC, at <http://www.devicelink.com/company98/enhanced/c/c00440.html.

Richart Distributors Incorporated, *Flomore Series 5200 Injector* product brochure, 5 pages.

Sidewinder Pumps, Inc, Chemical metering pumps brochure, 8 pages.

Texsteam, *Series 5100 Air or Gas Driven Injectors* brochure, 8 pages.

* cited by examiner

*Primary Examiner*—Charles G. Freay
(74) *Attorney, Agent, or Firm*—Townsend and Townsend and Crew LLP

(57) ABSTRACT

Various embodiments of the invention, therefore, provide pumps, and methods for their production. One exemplary embodiment of the invention comprises a ceramic plunger pump assembly. The pump assembly can include a pump body, which defines a pump chamber with an inlet port and an outlet port. The pump body can further define a plunger port disposed between the inlet port and the outlet port. In certain embodiments, the pump assembly can further include a ceramic plunger housing, which defines a cylindrical bore having an interior diameter. The plunger housing can be disposed within the plunger port. The pump assembly can also include a ceramic plunger. In particular embodiments, the ceramic plunger is slidably disposed within the cylindrical bore, such that the ceramic plunger may be reciprocated back and forth within the bore. Thus, the fluid can be moved from the inlet port of the pump chamber to the outlet port of the pump chamber through the reciprocal action of the plunger.

21 Claims, 10 Drawing Sheets

400

RECIPROCATING PUMP HAVING A CERAMIC PISTON

BACKGROUND OF THE INVENTION

The present invention relates generally to pumps and methods of their construction.

In the past, there has been a need for self-powered pumps which could be used without the presence of a separate power source (such as electricity) to perform certain tasks, including, for example, the injection of additives into gas lines, process tanks, and the like. A style of pump termed a "plunger pump" often has been used for such purposes. One such pump, described as a "fluid operated pump," is detailed in U.S. Pat. No. 3,093,122, the entire disclosure of which is incorporated herein for all purposes.

Those skilled in the art will ascertain that pumps generally, and plunger pumps in particular, depend on effective sealing members in order to avoid leakage of the material to be pumped. Without proper sealing, the material being pumped can tend to evacuate the pump chamber along the length of the plunger, instead of through the designed exit port. This leakage not only can reduce the efficiency of the pump, it can create maintenance issues and waste a fairly significant amount of the material being pumped. Hence, in the past, and in particular with plunger pumps, a variety of packing materials, including Polytetrafluoroethylene ("PTFE"), perfluoroelastomers (including, for example those commercially available from DuPont Dow Elastomers L.L.C.™ under the trade name KALREZ™), and various other polymers, plastics and the like have been used as sealing members to surround the plunger and prevent leakage of the fluid along the plunger.

Unfortunately, however, in order to adequately seal the plunger from leakage, such packing materials usually must maintain contact with the plunger as it moves reciprocally. The packing materials, therefore, tend to degrade relatively quickly (due at least in part to friction between the plunger, the packing material and/or the fluids being pumped, as well as the expendable nature of the packing materials themselves), allowing progressively more leakage over time. Moreover, as the packing materials degrade, there is a tendency by users to tighten the fitting on such pumps periodically as the packing materials degrade, compressing the packing materials to prevent this progressive leakage, which can significantly impact the efficiency of the pump and require more power for operation. Furthermore, over time, the packing materials can, in fact, score the plunger itself, requiring replacement of the plunger, which can be costly and time consuming. This problem, which can be mitigated, but generally not eliminated, by the use of lubricants to reduce friction, is exacerbated by the fact that such pumps often are used in relatively remote locations because of their desirability as being self-powered, such that they can run unattended for relatively long periods of time. Moreover, the use of lubricants imposes additional maintenance overhead and expense, and it presents the danger that the lubricant might contaminate the material being pumped.

What is needed, therefore, is a new type of sealing member and/or plunger system for such pumps.

BRIEF SUMMARY OF THE INVENTION

Various embodiments of the invention provide pumps, and methods for their production, that can be used to solve deficiencies in the prior art and provide many features and benefits. One exemplary embodiment of the invention comprises a ceramic plunger pump assembly. The pump assembly can include a pump body, which defines a pump chamber with an inlet port and an outlet port. The pump body can further define a plunger port disposed between the inlet port and the outlet port. In some embodiments, the pump body can be metallic. The pump assembly can further include a first check valve in fluid communication with the inlet port of the pump chamber, and the first check valve can be configured to allow a fluid to flow only into the pump chamber. Similarly, the pump assembly can include a second check valve in fluid communication with the outlet port of the pump chamber, and the second check valve can be configured to all allow fluid to flow only out of the pump chamber. The fluid can comprise a liquid and/or a gas.

In certain embodiments, the pump assembly can further include a ceramic plunger housing, which defines a cylindrical bore having an interior diameter. The plunger housing can be disposed within the plunger port. In accordance with certain embodiments, the pump assembly can also include a ceramic plunger. In some cases, the ceramic plunger can be cylindrical and thus can have an exterior diameter. In particular embodiments, the ceramic plunger is slidably disposed within the cylindrical bore, such that the ceramic plunger may be reciprocated back and forth within the bore. Thus, the fluid can be moved from the inlet port of the pump chamber to the outlet port of the pump chamber through the reciprocal action of the plunger.

In a certain aspect, the exterior diameter of the ceramic plunger can fit the interior diameter of the bore to within a certain tolerance. In some cases, the tolerance can operate generally to prevent fluid from escaping the pump chamber through the bore. In certain embodiments, the certain tolerance can be in the range from about 1.0 microns to about 6.0 microns, and preferably in the range of about 1.47 microns to about 2.45 microns. In other embodiments, the length of the plunger housing can be in the range from about 0.5 centimeters to about 10 centimeters. In some cases, the surface of the plunger can define a discontinuity, wherein the discontinuity is configured to reduce the escape of the fluid through the bore. In other cases, the plunger and/or the housing can be coated with a wear-resistant coating.

In accordance with various embodiments of the invention, the plunger and/or plunger housing can comprise a toughened aluminum oxide. In other embodiments, the plunger and/or housing can comprise transformation-toughened zirconia. Those skilled in the art will recognize that other types of ceramics can be employed as well, however, without varying from the scope of the invention. Merely by way of example, the plunger and/or the plunger housing can comprise an alumina, comprising 99.5 percent $Al_2O_3$.

Other embodiments of the invention include fluid injection systems. One exemplary fluid injection system can comprise a ceramic plunger pump assembly, perhaps as discussed above, and can further comprise a drive system configured to impart a generally reciprocal force on a plunger. Various embodiments can utilize any of a variety of drive mechanisms. Merely by way of example, in some embodiments, the drive system comprises a diaphragm motor. The diaphragm motor can be dynamically coupled to the ceramic plunger of the pump assembly and can be configured to reciprocally slide the ceramic plunger back and forth in the velour of the plunger housing. In this way, the diaphragm motor can operate to move a fluid from the inlet port of the pump chamber to the outlet port of the pump chamber. Some exemplary fluid injection systems can further include one or more fluid sources, some of which can be in fluid communication with the first check valve of the pump assembly and/or with the diaphragm motor. In some cases, some of the fluids can be pressurized.

In one aspect, the diaphragm motor can include a diaphragm and a linkage coupled to the diaphragm. The linkage can also be coupled to the ceramic plunger. In such embodiments, a fluid source can be in fluid communication with the diaphragm. Those skilled in the art will appreciate, therefore, that the diaphragm motor can be configured to reciprocally slide the ceramic plunger back and forth in the bore in response to a fluid pressure imposed on the diaphragm by the fluid source.

Other embodiments of the invention include methods for producing ceramic plunger pump assemblies and/or fluid (e.g., chemical) injection systems. One such exemplary method for producing a ceramic plunger pump assembly includes providing a pump body. The pump body can be metallic, and it can define a pump chamber. The pump chamber can have an inlet port and an outlet port, and the pump body can further define a plunger port disposed between the inlet port and the outlet port.

Methods in accordance with some embodiments further comprise heating the pump body from an ambient temperature to a certain temperature, where the plunger port expands a certain amount. Further, a ceramic plunger housing can be inserted into the plunger port. The plunger housing, in some cases, will define a cylindrical bore having an interior diameter.

The pump body can also be allowed to cool to the ambient temperature. This cooling can cause the pump body to contract, perhaps placing the ceramic plunger housing under compression. A ceramic plunger can be slidably disposed within the cylindrical bore of the plunger housing and the ceramic plunger can have an exterior diameter that is smaller than the interior diameter of the cylindrical bore. In certain aspects, allowing the pump body to cool to the ambient temperature can have the effect of forcing the internal diameter of the bore to contract to within a certain tolerance of the external diameter of the plunger.

In accordance with some embodiments, the certain temperature can be in the range of about 200° F. to about 700° F., and preferably in the range of about 300° F. to about 700° F. The plunger housing and/or the plunger can comprise any of a variety of ceramics, including toughened aluminum oxides, transformation toughened zirconia, and/or alumina compounds, including, for example, one which comprises approximately 99.5 percent $Al_2O_3$.

DETAILED DESCRIPTION OF THE INVENTION

Among other things, embodiments of the invention provide plunger pumps, as well as methods for their production. In accordance with certain embodiments, a plunger pump can comprise a pump chamber and a ceramic plunger housing, as well as a ceramic plunger slidably disposed within a bore defined by the plunger housing. In a certain aspect, the outside diameter of the plunger can fit the inside diameter of the housing to within a certain tolerance, and the tolerance can operate to prevent the material being pumped from escaping from the pump chamber through the bore. In another aspect, for a plunger and housing exhibiting a certain tolerance, the length of the housing can be designed to control the rate of any leakage.

According to various embodiments of the invention, a ceramic plunger and housing can operate to allow essentially leak-proof pumping mechanism without the need for any packing materials, which, those skilled in the art will recognize, can tend to degrade over time, requiring periodic maintenance and/or replacement. Thus, the ceramic housing and/or plunger can provide improved pumping performance over a longer period of time and with less maintenance than traditional plunger/packing arrangements. For instance, pumps according to certain embodiments often consumer fewer expendable parts (e.g., packing, packing nuts, etc.) and require less adjustment (and therefore less travel time for maintenance personnel).

In some cases, the plunger and/or housing can be lubricated periodically, and in other cases, the components can be "pre-lubricated," such that periodic addition of lubricants to the components in unnecessary. In still other cases, the ceramic plunger and/or housing can be operated without any lubricant at all, since the ceramic materials of which the housing and/or plunger are comprised can be relatively impervious to frictional degradation, and since the tolerance between the plunger and housing reduces the continual frictional contact between the two components. Thus, by reducing frictional contact, both power requirements and component wear can be reduced. Further, ceramic components in accordance with embodiments of the invention can be relatively impervious to temperature, wear, corrosion and reactive chemicals when compared to more traditional materials, such as steel and the like. Hence, pumps in accordance with embodiments of the invention can pump a variety of materials at various pressures and temperatures while exhibiting relatively low power requirements, wear and/or leakage.

Figure 1:
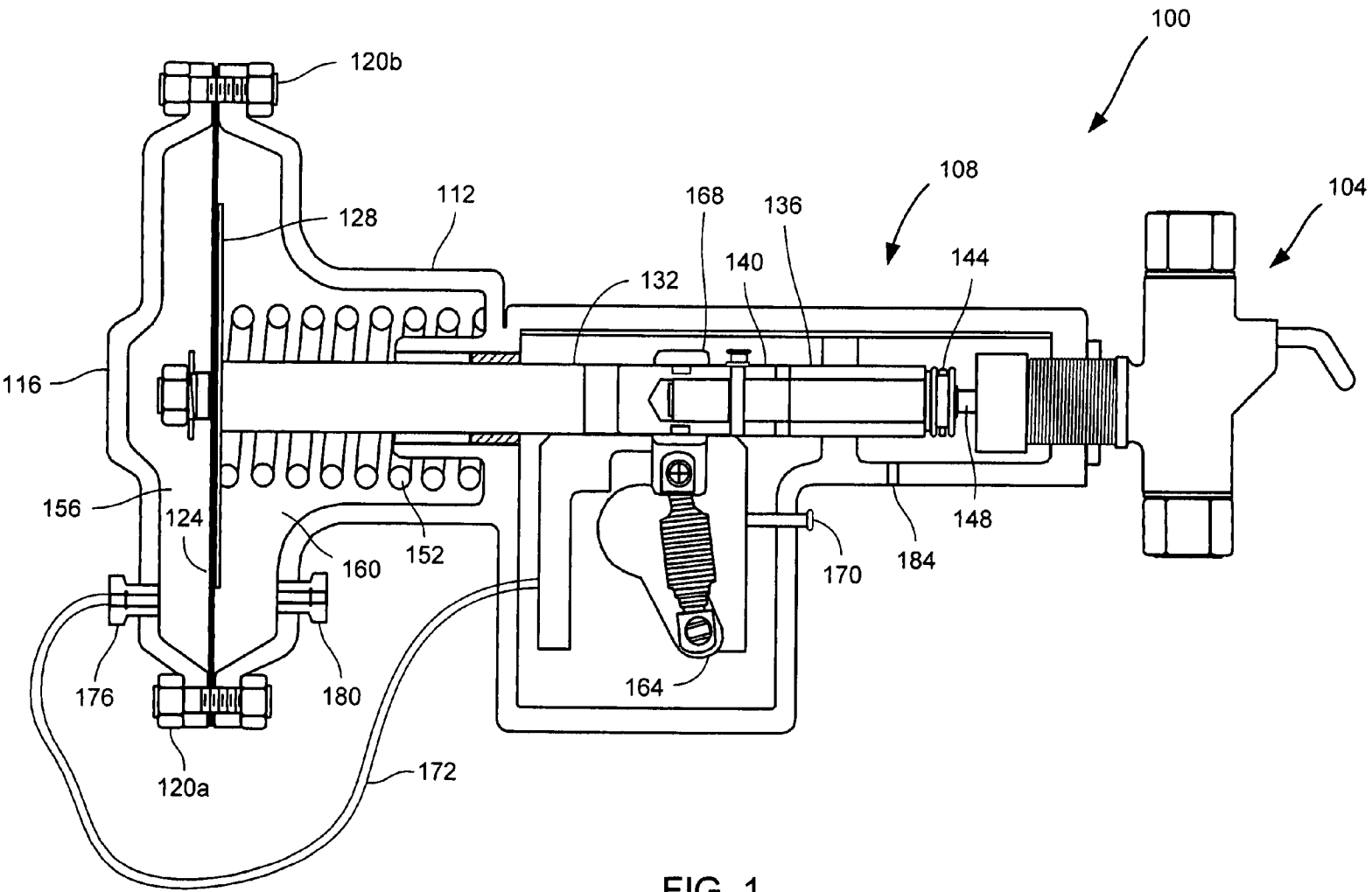
FIG. 1 is a schematic drawing illustrating a fluid injection system in accordance with various embodiments of the invention.

Turning now to FIG. 1, an injection system 100 is illustrated in accordance with certain embodiments of the invention. Injection system 100 generally includes an injection head 104 and a drive system 108. The drive system 108 can be any of several drive systems known in the art, including electric motors, lever-operated drives, and the like. In the illustrated embodiment, the drive system 108 comprises a diaphragm motor, which can be used to provide reciprocating action for a plunger in accordance with certain embodiments of the invention. An external housing 112 and a diaphragm cover 116, which can be fixedly attached to housing 112 (e.g., via hex bolts 120*a*, 120*b*). Although illustrated in FIG. 1 as a cutaway drawing, those skilled in the art will recognize that diaphragm cover 116 and the portion of housing 112 to which it is coupled can form two generally circular, opposing faces.

The diaphragm motor can comprise a molded diaphragm 124 adjacent to a rigid diaphragm plate 128. The diaphragm plate 128 can be fastened to the diaphragm 124, as well as to a linkage 132, perhaps using a hex bolt, to allow movement of the diaphragm 124 (and, therefore, the diaphragm plate 128 as well) to impose generally oscillating lateral forces on the linkage 132, causing it to move reciprocally. The linkage 132 can be fastened to a thrusting rod 136 via a rod adapter 140, and the thrusting rod can include a coupling mechanism 144, that can be coupled to a plunger 148. The plunger 148 can be disposed generally in a pump assembly (e.g., injection head 104), in a manner described in more detail below. The coupling mechanism 144 can, in certain embodiments, comprise a pin. Also fixedly coupled to the diaphragm plate 128 can be a return spring 152, the function of which is described in detail below.

In some embodiments, the circumference of diaphragm 124 can be sandwiched between diaphragm cover 116 and housing 112 (and, optionally, secured by hex bolts 120*a*, 120*b*), forming two chambers 156, 160, with a generally airtight seal therebetween. Those skilled in the art will appreciate, therefore, that the diaphragm 124 can be made of any flexible, moldable material that can be used to form an airtight seal, including, for example, silicone, rubber, nylon or the like, using any of a variety of well-known fabrication methods. The diaphragm plate 128 can comprise any rigid material capable of withstanding the sometimes opposing forces imparted by the diaphragm 124 and the return spring 152. For instance, in certain embodiments, the diaphragm plate 128 can be made of steel, aluminum or the like. Those skilled in the art will appreciate that the return spring 152 can comprise any material of sufficient strength that is capable of remaining elastic under repetitive compressive loads, such as, merely by way of example, a cadmium-plated carbon steel.

The linkage 132 can be coupled to a reciprocating mechanism 164 by a stirrup assembly 168, which can be attached to the reciprocating mechanism 164 with a pin and can define a collar around the linkage 132, secured, for example, by a set screw. The use of such a stirrup assembly is known to those skilled in the art and therefore will not be described in further detail. In this way, any lateral movement of the linkage 132 can be translated to a toggling force on the reciprocating mechanism 164.

In general, reciprocating mechanism 164 can be any mechanism and/or device that operates to translate a constant fluid pressure into a generally oscillating force, and, in some embodiments, can operate by a toggling mechanism. Merely by way of example, reciprocating mechanism 164 can comprise a "flipper" spring valve known to those skilled in the art. Reciprocating mechanism 164 can be coupled to a fluid source via an adapter (not shown on FIG. 1), such as a ¼" threaded female receptacle known to those skilled in the art. In this way, the reciprocating mechanism 164 can receive a pressurized fluid. The reciprocating mechanism also can be coupled to both an exhaust vent 170, as well as to a pilot line 172, which can provide fluid communication from reciprocating mechanism 164 to the chamber 156. In this way, reciprocating mechanism 164 can provide switchable fluid communication between the pressurized fluid source, the chamber 156 and the exhaust vent 170.

Embodiments of the invention can be configured to operate with a variety of pressurized fluids. Often such fluids can be gases, such as pressurized air, natural gas, wellhead gases, and the like, but they can, in accordance with some embodiments, be liquids as well. In some embodiments, the fluid can be pressurized to any suitable pressure, which, in some embodiments can be about 15–150 psi, and/or a regulator can be used to reduce the operating pressure of the gas. Merely by way of example, fluid injection systems in accordance with various embodiments can be used to inject an additive into a pressurized fluid stream, such as a gas line or the like. In such embodiments, a pilot line branching off of the main gas line can be the source of pressurized fluid to drive the diaphragm motor.

In a default state, return spring 152 is under no compression, diaphragm plate 128 is disposed proximate to diaphragm cover 116, and the reciprocating mechanism 164 is configured (as a result of the position of the linkage 132) to route the pressurized fluid toward the chamber 156. In operation, when a pressurized fluid source is attached to the reciprocating mechanism 164, the fluid flows from the reciprocating mechanism 164, through the pilot tube 172 and the adapter 176, into the chamber 156. The fluid can create sufficient pressure in the chamber 156 to displace the diaphragm 124 away from the diaphragm cover 116, thereby placing the return spring 152 under compression. This displacement will also cause the linkage 132 to move generally away from the direction of the diaphragm cover 116 and toward the injection head 104.

At a certain point, (i.e., when the diaphragm 124 has moved sufficiently far away from to the diaphragm cover 116), the linkage 132 will have completed a full forward stroke, displacing trip stirrup 168, thrusting rod 136, and, by extension, plunger 148. At this point, the displacement of trip stirrup 168 will toggle the reciprocating mechanism 164. When toggled, the three-way valve of the reciprocating mechanism 164 will operate to close the connection between the pressurized fluid source and the chamber 156 and will instead allow the pressurized fluid already in chamber 156 to vent to the environment (and/or a suitable collection device) through exhaust vent 170, thereby acting to reduce the pressure in the chamber 156. The other chamber 160 can be vented to the atmosphere, for instance, through vent 180, to maintain roughly atmospheric pressure in that chamber 160, preventing any positive or negative pressure therein from affecting the movement of the diaphragm 124.

When the pressure in the chamber 156 has decreased sufficiently, the force imposed on the diaphragm plate 128 by that pressure will be overcome by the force of the loaded return spring 152, causing the plate 128 (and, in connection, the diaphragm 124) to return to the default position, forcing the linkage 132 to reciprocate toward the diaphragm cover 116 and away from the injection head 104, thereby displacing trip stirrup 168 toward its default position and moving the thrusting rod 136 and plunger 148 in the direction of the injection head 104. (Alternatively, instead of using a return spring 152, the diaphragm motor can be configured so that pressurized fluid can be routed alternately to chambers 156 and 160, thereby producing a similar reciprocal effect on the diaphragm 124.) When the linkage 132 has reciprocated to the extent of its back stroke, the displacement of the trip stirrup 168 will again toggle the reciprocating mechanism 164, causing the process to repeat. In this way, the diaphragm motor, as described generally above, can produce a reciprocating action of the linkage 132 when exposed to a constant pressure fluid source. Via the thrust rod 136, the reciprocating action of the linkage 132 can cause the plunger 148 to move reciprocally within the injector head 104.

As discussed in detail below, the plunger 148 contacts the fluid to be injected, which can be a different fluid than the pressurized fluid used to drive the diaphragm motor, discussed above. Merely by way of example, materials that can be injected using embodiments of the invention include surfactants, defoamers, biocides (including bleach), corrosion inhibitors (including toluene, xylene, etc.), demulcifiers, solvents, paraffin inhibitors, scale inhibitors, pH buffers, hydrogen sulfide scavengers, water clarifiers, coagulants, methanol, acids (including, in particular, hydrochloric, phosphoric and acetic acids), alcohols (including, in particular, methanol), and the like. Hence, a wide variety of materials can be pumped/injected by embodiments of the invention, and, in some cases, a small amount of the material to be injected might escape the injector head 104 via transmission along the plunger 148. To accommodate such situations, and/or to allow the monitoring of any leakage (e.g., for maintenance purposes), the housing 112 can define a drain 184 to collect and/or allow the escape of leakage.

Figure 2:
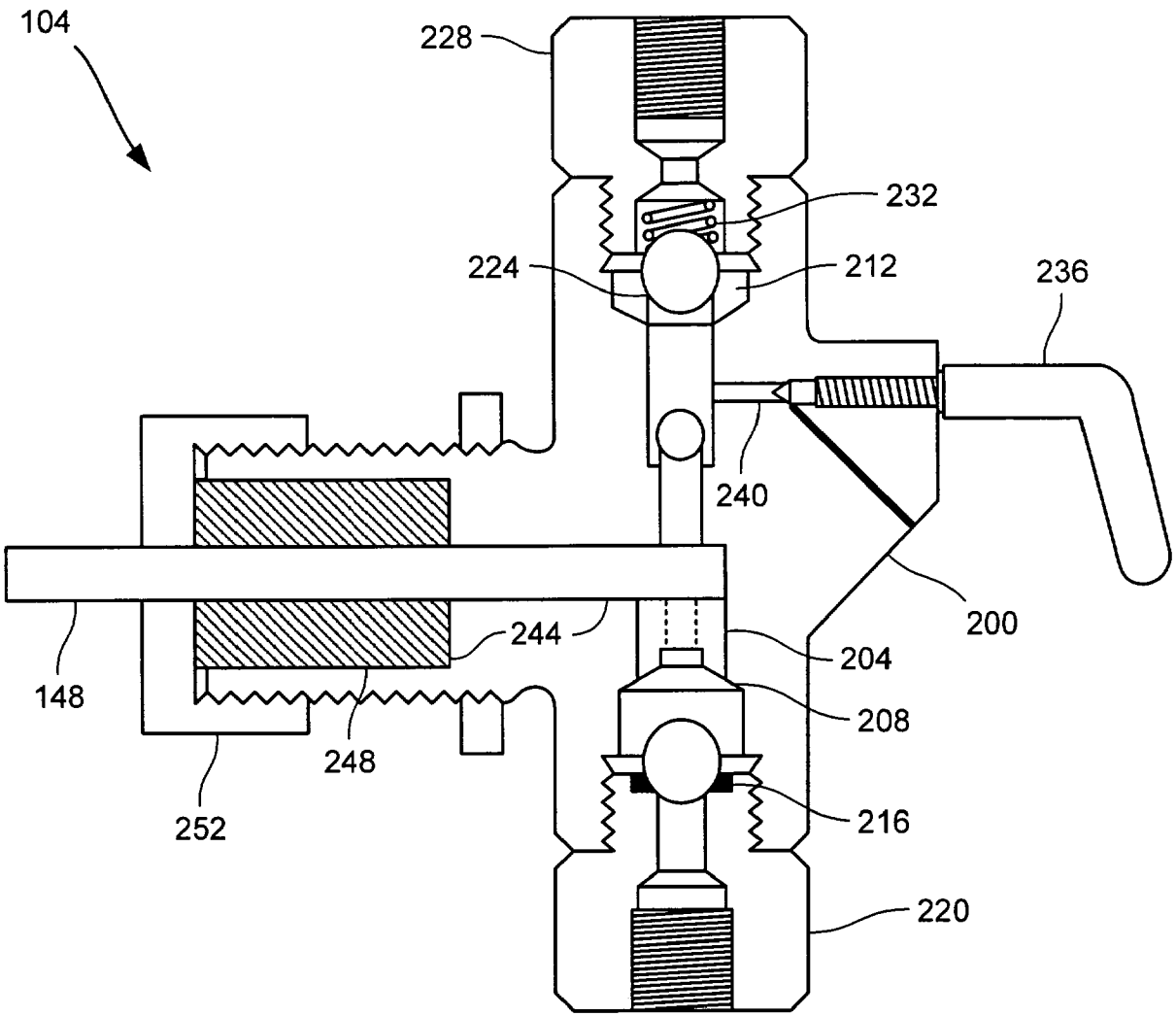
FIG. 2 is a sectional drawing of an injector head, including a pump assembly in accordance with various embodiments of the invention.

Turning now to FIG. 2, an injection head 104 in accordance with various embodiments of the invention is illustrated. The injection head 104 can generally comprise a pump assembly, including a pump body 200. The injection head 104 can be attached to a drive mechanism, such as the drive system 108 of FIG. 1, to form an injection system such as that represented by reference numeral 100.

The pump body 200 can define a pump chamber 204, which can have an inlet port 208 and an outlet port 212. The inlet port 208 can be in fluid communication with a check valve 216, known to those skilled in the art, and pump body 200 can include an attachment mechanism 220, which can be a threaded bushing, for attaching a supply line to be in fluid communication with the inlet port 208 through the check valve 216. Thus, when in operation, as discussed below, the injection head 104 can draw fluid from the supply line, and the check valve 216 can prevent the backflow of any fluid from the pump chamber 204 into the supply line. Likewise, the outlet port 212 can be in fluid communication with a check valve 224, and further in fluid communication with a discharge line, through attachment means 228. Either check valve 216, 224 can be a suction ball assembly, which, as those skilled in the art will recognize, will effectively allow for one-way transmission of fluid. If necessary, check valve 224 can include a spring 232 to provide increased resistance and further ensure against backflow into the pump chamber 204. Optionally, injection head 104 can include a threaded priming key 236, which, when backed out of the priming port 240, will create a small vacuum in the pump chamber 204, drawing fluid through the inlet port 208 and thereby priming the injection head 104 for pumping.

The pump body 200 can further define a plunger port 244, which, in certain embodiments, extends from the exterior of the pump body 200 to the pump chamber 204. As illustrated in FIG. 2, the plunger port 244 can define a relatively narrow void extending away from the pump chamber 204 and can define a wider void near the exterior of the pump body 200. The plunger port 244 can be adapted to hold a plunger housing 248 within the wider void. Generally, the plunger housing 248 can fit relatively tightly within the plunger port 244 in order to prevent excess leakage of fluid from the pump chamber 204. As discussed in greater detail below, the relative sizing of the plunger housing 248 and the interior of the plunger port 244 can, in some cases, be designed to place the plunger housing under compression. In certain embodiments, a cap 252 can be used to secure the plunger housing 248 within the plunger port 244. In other embodiments, the cap can serve additional purposes. For instance, the cap 252 could be designed to attach to the pump body 200 with a compression fitting, such that attachment of the cap 252 could be used to place the plunger housing 248 under compression. In still other embodiments, the cap 252 can comprise a fitting for attaching the pump insertion head 104 to a drive mechanism, such as the diaphragm motor of FIG. 1.

A plunger 148 can be slidably disposed within the plunger housing 248, such that, when fully inserted, the plunger 148 extends through to contact the far wall of the pump chamber 204, effectively displacing a substantial proportion of the volume of the pump chamber 204. The plunger 244 can, thereafter, be withdrawn from the pump chamber 204, effectively removing the displacement and thereby creating a state of relative vacuum in the pump chamber 204 and drawing fluid from the inlet port 208. When reinserted in the pump chamber 204, the plunger 148 can again displace a substantial proportion of the volume of the chamber 204, forcing at least a portion of the fluid in the pump chamber 204 through the outlet port 212 (the check valve 216 can prevent discharge through the inlet port 208. In this fashion, if moved in and out of the pump chamber 204 with a reciprocating action, plunger 148 can be used to pump fluid from the inlet port 208 through the pump chamber 204, to the outlet port 212. Thus, when coupled to a drive system motor, such as that illustrated in FIG. 1, the injector head 104, through the action of the plunger 148, can be used to pump a fluid from a supply line to a discharge line, and can further be used to inject a first fluid into a second fluid. In some cases, the second fluid can be the pressurized fluid that powers the diaphragm motor, allowing for an essentially self-powered injection system.

In accordance with certain embodiments, the plunger 148 and/or plunger housing 248 can comprise a ceramic material. In many cases, the plunger 148 and housing 248 will comprise like materials, although in other cases, the plunger 148 and the housing may comprise different materials. Merely by way of example, in a particular embodiment, plunger 148 and/or plunger housing 248 can comprise an alumina compound. There are a variety of such compounds commercially available, including, for instance, a ceramic blend commonly known in the art as AD-995, which, those skilled in the art will appreciate, generally comprises about 99.5 percent $Al_2O_3$. AD-995 is commercially available from Coorstek, Inc., of Golden, Colo. Those skilled in the art will further recognize that other alumina compounds can be used as well. For example, certain embodiments of the invention employ a plunger 148 and/or housing 248 made of a ceramic comprising approximately 99.8 percent $Al_2O_3$, known in the art as AD-998, and/or an alumina comprising approximately 98.5 percent $Al_2O_3$, known in the art as FG-985, all available from Coorstek.

In still further embodiments, other ceramics can be used as well, including, for example, those comprising hardened aluminum oxide. Some such ceramics further comprise proportions of zirconia, and one exemplary embodiment employs a material known in the art as transformation toughened zirconia ("TTZ"), also commercially available from Coorstek. Those skilled in the art will recognize that TTZ can, in some cases, be partially stabilized, for instance, by the introduction of certain proportions of MgO. Various embodiments can comprise other types of zirconia and/or alumina compounds, such as those known in the art as tetragonal zirconia polycrystals ("TZP"), yttria stabilized zirconia polycrystals ("YTZP"), ceria stabilized tetragonal zirconia polycrystals ("CeTZP"), other ceria compounds, and/or zirconia toughened aluminas ("ZTA"). Those skilled in the art will recognize, based on the disclosure herein, that other ceramic materials may be used as well, including for instance, silicon carbides and tungsten carbides. In certain aspects, such materials often will have a relatively low co-efficient of thermal expansion and/or a relatively high degree of abrasion resistance. In some cases, the plunger and/or the plunger housing can be coated in order to improve performance parameters such as wear resistance, coefficient of friction, etc. Virtually any desired material can be used as a coating, although monolithic materials are used most often. In particular cases, any of the materials discussed above can be used as a coating material, depending on the requirements of specific implementation.

Figure 3A:
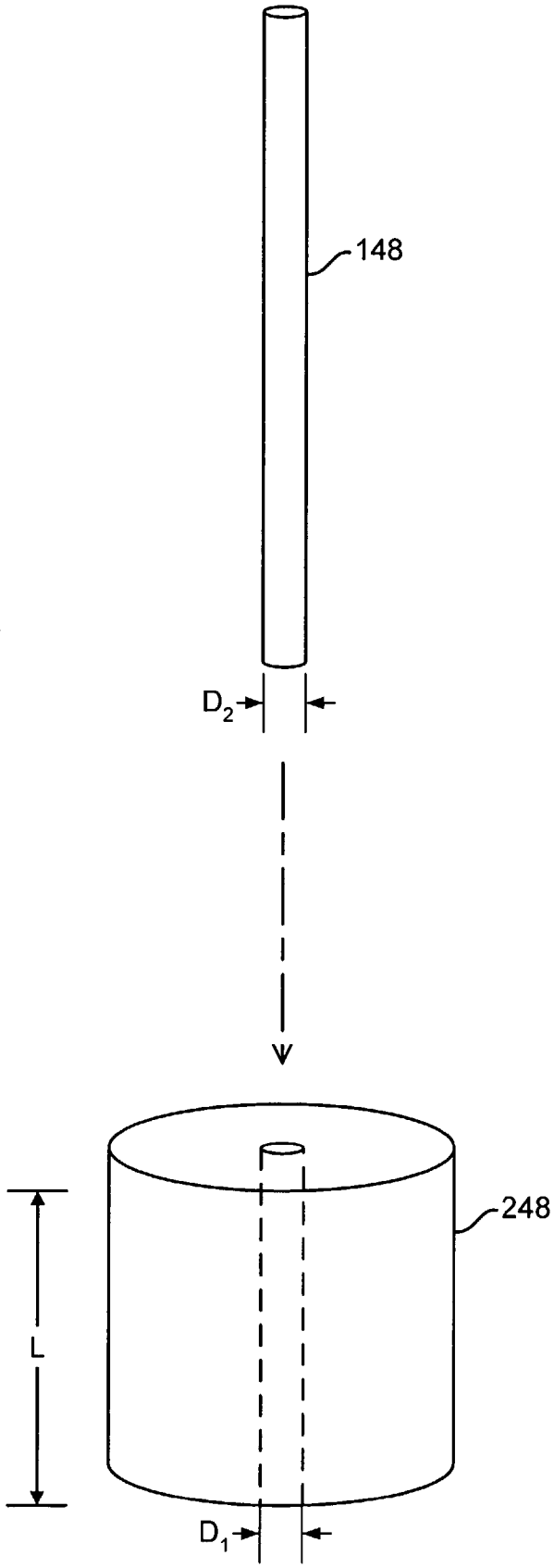
FIG. 3A is a perspective drawing of a plunger housing and plunger that can be used in accordance with various embodiments of the invention.
Figure 3B:
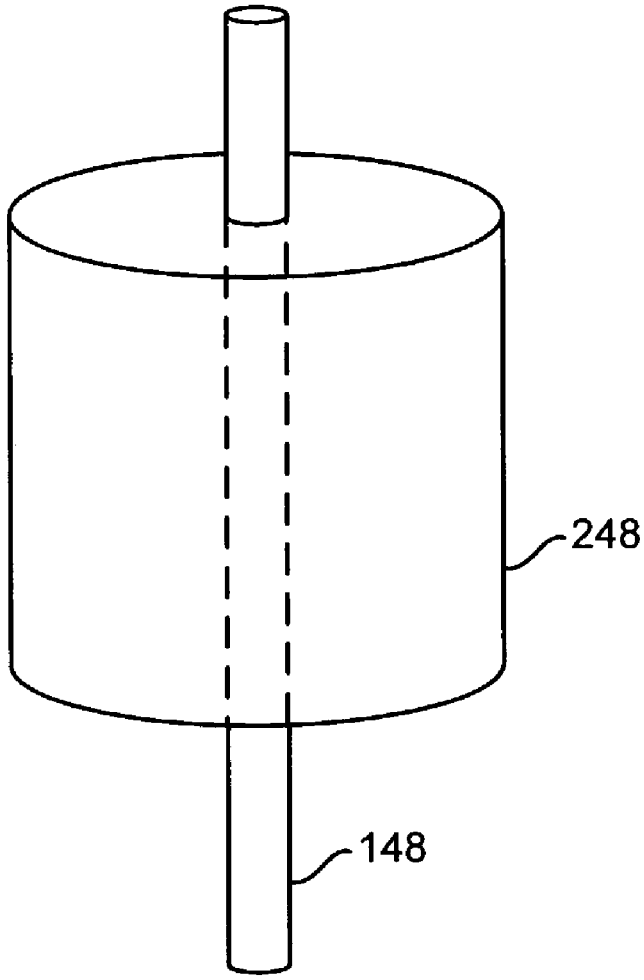
FIG. 3B is a perspective drawing of the plunger of FIG. 3A slidably disposed within the plunger housing.

Turning briefly now to FIG. 3A, a perspective drawing of the plunger 148 and the plunger housing 248 is illustrated. As illustrated, the plunger housing 248 can describe a bore, which, in some embodiments, can be generally circular, having an interior diameter $D_1$. The plunger 148, on the other hand, can have an exterior diameter $D_2$. Generally, the exterior diameter $D_2$ of the plunger 148 will be smaller than the interior diameter $D_1$ of the bore, such that the plunger 148 can be slidably disposed within the plunger housing 248, as illustrated, for example, in FIG. 3B. In accordance with embodiments of the invention, the plunger 148 and/or plunger housing 248 can be manufactured so that the tolerance (i.e., clearance) between $D_1$ and $D_2$ is within a few microns. For example, in certain embodiments, the tolerance between $D_1$ and $D_2$ can be in the range of about 1.2 microns to about 1.8 microns. In other embodiments, the tolerance between $D_1$ and $D_2$ can be in the range of about 1.47 microns and about 2.45 microns. In some embodiments, as discussed above, the plunger 148 and/or housing 248 can be manufactured of ceramic materials, which, those skilled in the art will recognize, can have a relatively low coefficient of thermal expansion, allowing for relatively precise tolerances even in applications where the plunger 148 and/or housing 248 might be subjected to variations in temperature.

In some embodiments, as discussed below, in addition to the tolerance between $D_1$ and $D_2$, the length L of the housing 248 can impact the ability of the housing to prevent leakage of the material being pumped. Generally, the longer the plunger housing 248, the lower the rate of leakage that would be expected for a plunger and housing having a given tolerance. Thus, for pumps operating with materials with lower Reynolds numbers and/or pumps operating at higher pressures, either a tighter tolerance between the plunger and the housing and/or a longer housing can be employed to further assure against unacceptable leakage rates. In some exemplary embodiments, the plunger housing can be between 0.5 and 10.0 cm, although longer and/or shorter housings can be used, depending on operating conditions, as discussed herein. Moreover, as discussed in detail below, the characteristics of the facial profile and/or outer surface of the plunger 148, as well as the inner surface of the plunger housing 248, can be modified to effect different leakage rates of different materials.

Returning now to FIG. 2, the tolerance between the exterior diameter of the plunger 148 and the housing 248 can allow the plunger 148 and the plunger housing 248 to be used in the operation of the injection head 104 without the need for any seals, gaskets or lubricants. In effect, the relatively precise tolerance between the two parts can allow the plunger 148 to reciprocate freely within the plunger housing 248, in the manner described above, while preventing any substantial leakage of fluid through the bore of the plunger housing 248. (Of course, any fluid that does leak through the bore can be collected and/or evacuated through drain 180, as described above with regard to FIG. 1). Those skilled in the art will recognize that the amount of leakage through the bore depends on the properties of the fluid in pump chamber 204, including the pressure imposed on the fluid and the Reynolds number of the fluid, as well as the length of the plunger housing 248 and the tolerance between the exterior diameter of the plunger 148 and the interior diameter of the housing 248.

Figure 4A:
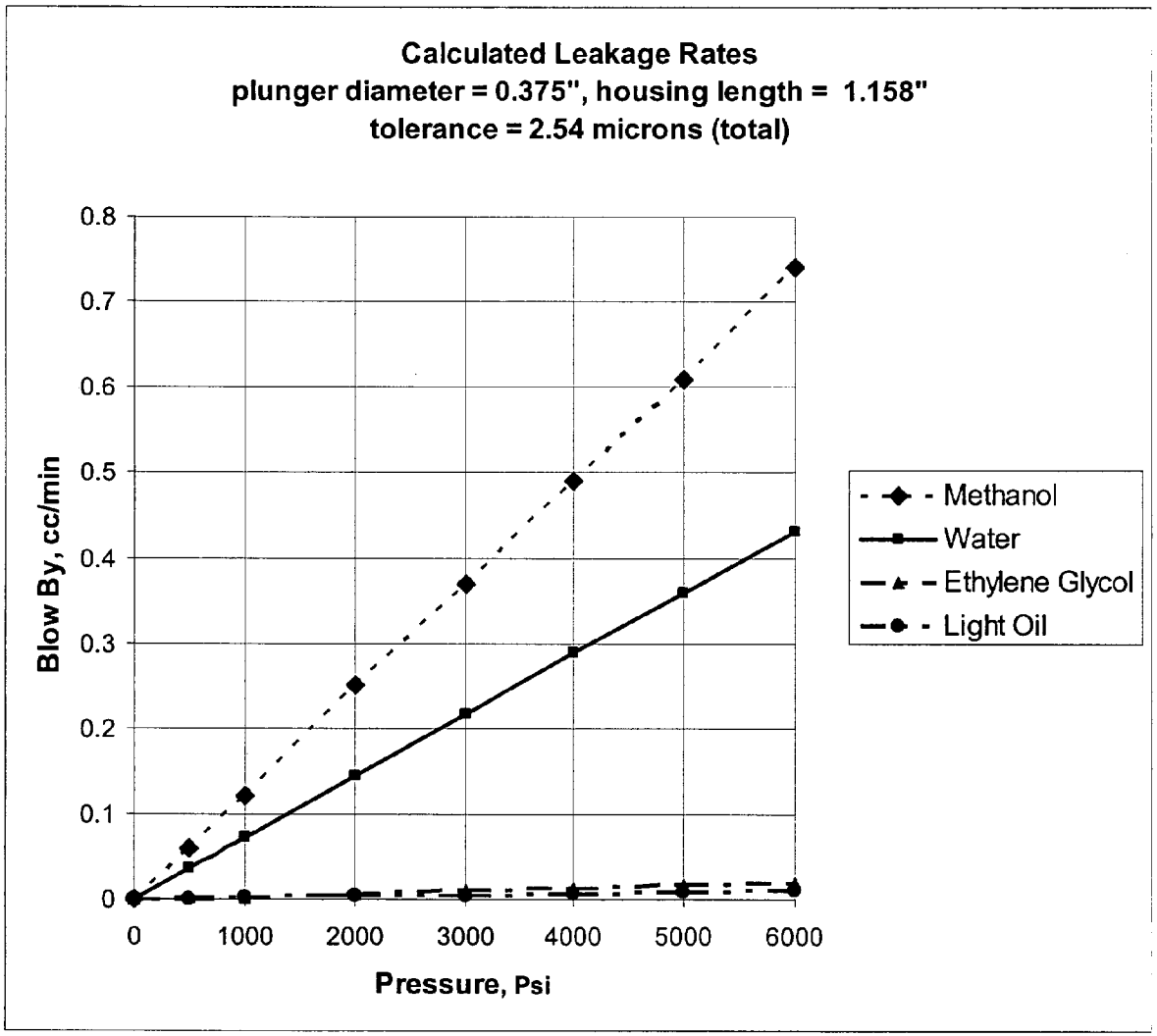
FIGS. 4A and 4B are graphs illustrating, for a variety of fluids, the sealing performance of pump assemblies in accordance with various embodiments of the invention.
Figure 4B:
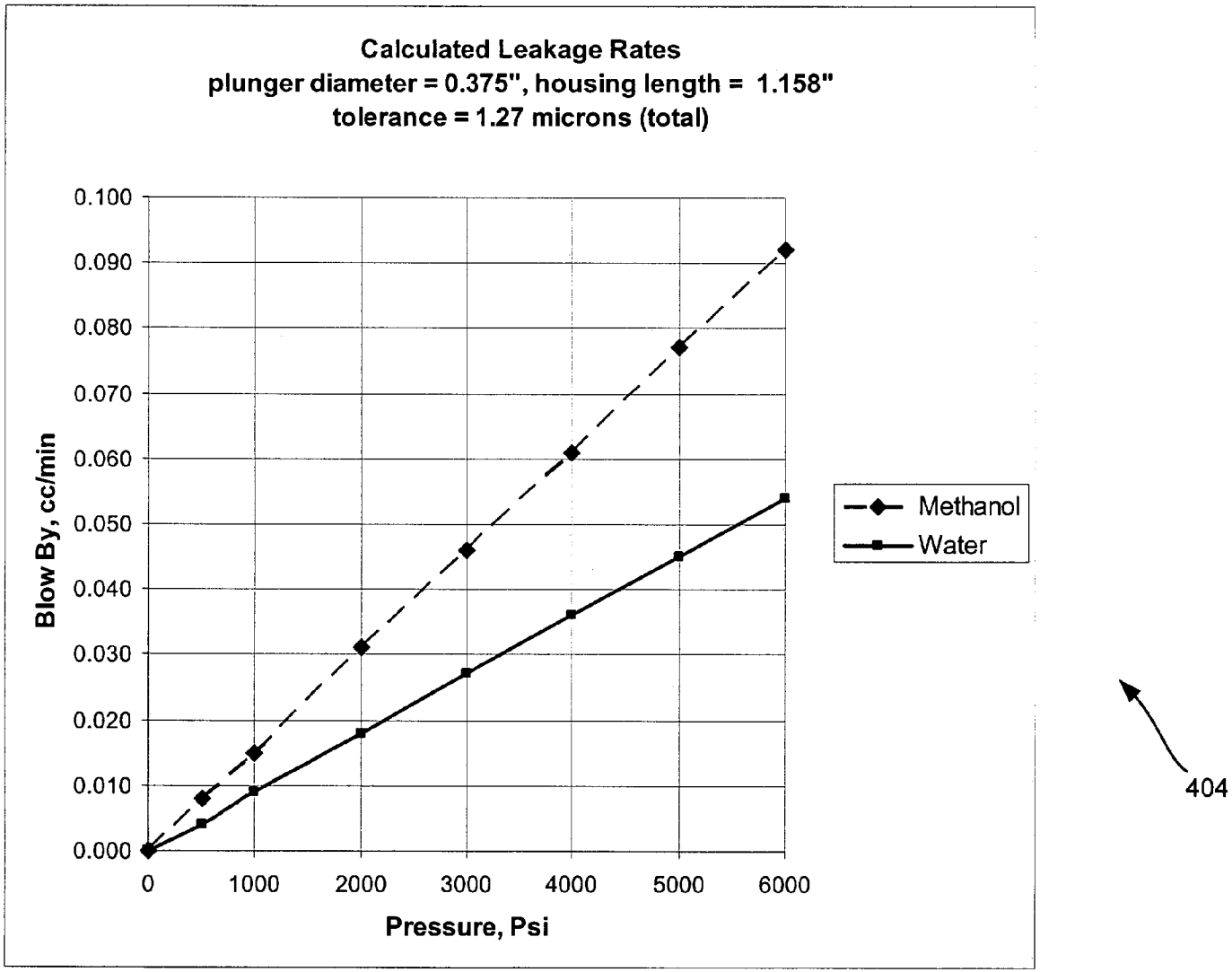

FIGS. 4A and 4B depict charts (400 and 404, respectively) illustrating a set of calculated leakage rates (also known in the art as "blow by" rates) for particular embodiments of the invention, with respect to several exemplary fluids. FIG. 4A illustrates the calculated rates at which four different fluids could be expected to blow through the bore of an exemplary plunger housing during operation of the injector head. The exemplary plunger housing used to calculate the rates is 1.158 inches in length and can accommodate a 0.375 inch plunger with 1.27 microns of clearance on either side (for a total of 2.54 microns tolerance). The calculated values exhibited in FIG. 4A assume that the plunger has a face that is flat and perpendicular to the length of the plunger and that the plunger includes no discontinuities along its length. For relatively low-viscosity fluids, such as Methanol, under relatively high pressure, somewhat greater leakage rates might be expected (slightly more than 0.7 $cm^3$ per minute at a pressure of 6000 psi). On the other hand, with more viscous fluids (for example, with ethylene glycol), even at such high pressures, very little leakage would be expected. Given the disclosure herein, those skilled in the art will recognize that increasing the length of the housing and/or decreasing the tolerance between the plunger and the housing can reduce the expected leakage rates.

For instance, FIG. 4B includes a chart 404 depicting calculated data for an exemplary plunger housing similar to the plunger housing analyzed in FIG. 4A, except that the tolerance between the plunger and the housing is 0.127 microns (total). As illustrated by the chart 404, the leakage rates for this embodiment are almost an order of magnitude lower than those for the exemplary plunger of FIG. 4A. In this way, those skilled in the art will appreciate, reducing the clearance between the plunger housing bore and the plunger can provide significant improvements in leakage performance. Those skilled in the art will recognize, as well, that a longer plunger housing likewise will lead to reduced leakage. In addition, as discussed below, altering the facial profile of the plunger and/or introducing discontinuities in the surface along the length of the plunger can affect expected leakage rates as well.

Figure 5:
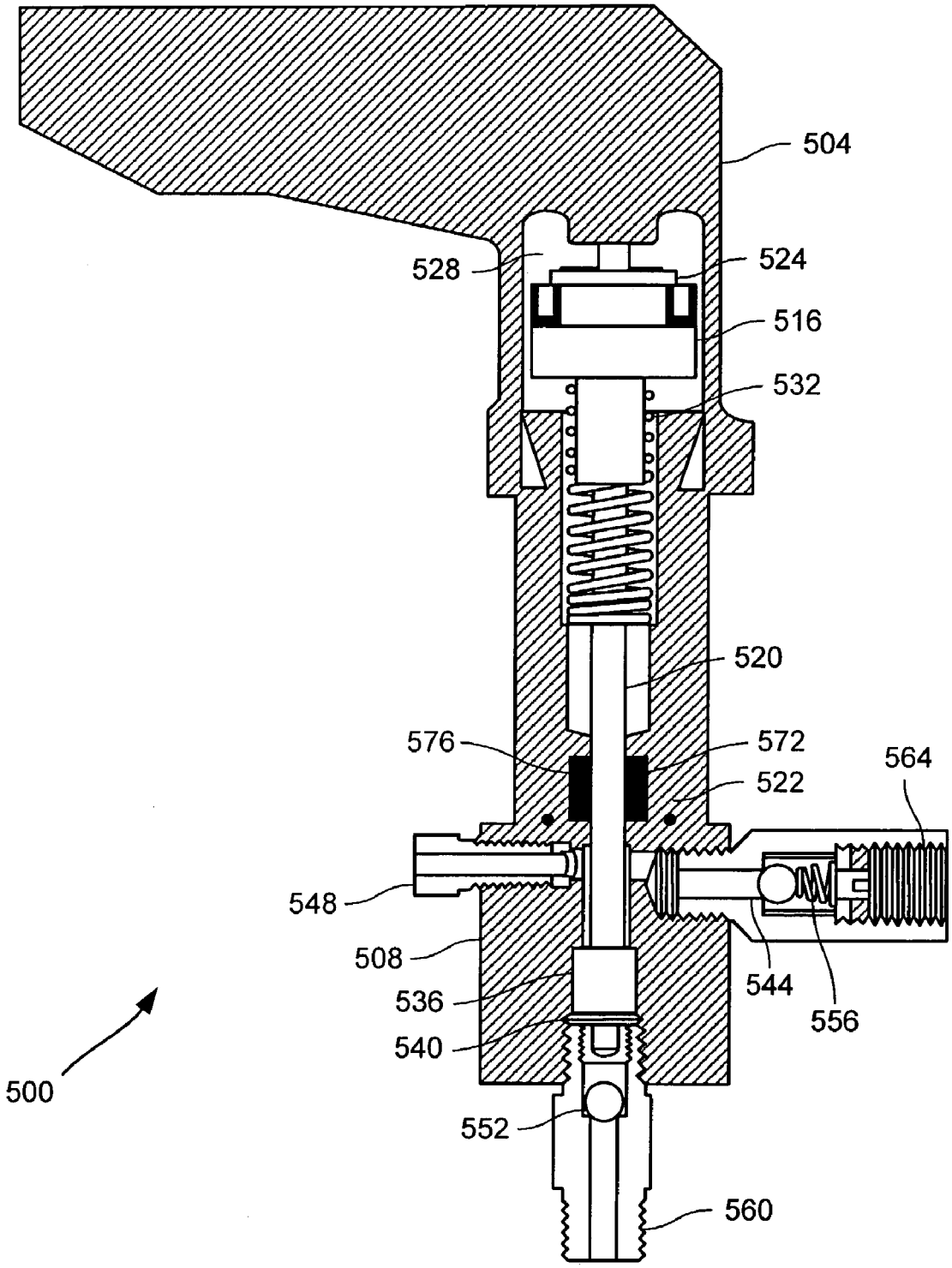
FIG. 5 is a schematic drawing illustrating a fluid injection and pump assembly in accordance with various embodiments of the invention.

Turning now to FIG. 5, an alternative embodiment of a pump 500 in accordance with the present invention is illustrated. The pump 500 generally comprises a power head 504 and a pump body 508. The power head can include any drive system (not shown). A piston-plunger assembly 516 is disposed within the power head 504, with the plunger portion 520 of the assembly 516 extending into the pump body 508. The drive system can be any device that is capable of moving the piston-plunger 516 vertically in a generally reciprocal fashion (including without limitation the drive systems described elsewhere in this disclosure), and it can be integrated with the power head 504, or alternatively, can be a separate device that can be attached via suitable fastening apparatus. The power head 504 can be securely and/or removably attached to the pump body 508, using fasteners such as bolts, locknuts and the like. In certain embodiments, the power head 504 can be coupled to the pump body via a threaded attachment member 522. Optionally, a stroke-limiter 524 can be implemented in the power head 504, to limit the length of the stroke of the piston-plunger 516 and thereby control the pump rate, pump chamber pressure, etc.

The drive system can be coupled to the piston-plunger 516 in any of several different ways. For instance, in certain embodiments, the drive system can be an electric motor with a linkage, and the linkage can be coupled to the piston-plunger 516. Methods of coupling an electric motor to a piston to produce a generally reciprocal motion are well known in the art and will not be discussed in detail herein. In other embodiments, the drive system can comprise a device similar to the toggling switch discussed in conjunction with FIG. 1, and can be in fluid communication with a pressurized fluid source. In such embodiments, the drive system can be operable to pressurize/depressurize, in oscillating fashion, a chamber 528 within the power head 504, forcing the piston-plunger 516 downward against a return spring 532, which, when the pressure in the chamber 528 is reduced, can force the piston-plunger 516 up to its original position.

Other means of imparting reciprocal motion to the piston-plunger 516 (including manual manipulation of the piston-plunger 516, in which case, the drive system could be a lever coupled to the piston-plunger 516) can be incorporated within the scope of the invention as well. Those skilled in the art will recognize that certain illustrated components, such as, for example, return spring 532, may be considered optional, and other components well known in the art can be included, depending on the nature of the drive system, so long as the chosen device operates move piston-plunger 516 in a vertical, generally reciprocal fashion.

The pump body 508 can define a pump chamber 536 having an inlet port 540 and an outlet port 544, as well as an optional bleeder valve 548, to prevent overpressure in the pump chamber 536. The inlet port 540 and the outlet port 544 each can have a check valve (552 and 556, respectively), and the inlet port 540 can be in fluid communication (perhaps through the check valve 552) with an adapter 560 for attachment to a line supplying the material to be pumped. Likewise, outlet port 544 can be in fluid communication (e.g., through the check valve 556) with an adapter 564 for a discharge line. The discharge line optionally can be configured to feed into a pressurized line, so that pump 500 can be used to inject additives, etc. into pressurized fluid streams. As discussed above, in certain embodiments, the pressurized fluid stream can be used to power the drive system, such that pump 500 can use the pressure of a fluid stream itself to introduce additives into that stream.

In the illustrated embodiment, the pumping operation is similar to that described above. The plunger portion 520 can be drawn out of the pump chamber 536 by the action of the drive system, creating negative pressure in the pump chamber 536. The negative pressure will draw fluid through the inlet adapter 560, check valve 552 and inlet port 540, into the pump chamber 536. When the piston-plunger has reached the end of its upward stroke (e.g., when it strikes stroke limiter 524), it will begin a downward stroke. Prevented by the check valve 552 from escaping the pump chamber 536 through the supply line, the material in the pump chamber will be evacuated through the outlet port 544, check valve 556 and adapter 564, perhaps to an attached discharge line. If, for some reason, evacuation through the outlet port 544 is prevented (e.g., if the discharge line is blocked), the bleeder valve 548 can prevent damage to the pump 500 by allowing the material to escape when the pressure in the pump chamber 536 reaches a predetermined threshold.

To stabilize the plunger 520 and prevent migration of pumped material out of the pump chamber 536 and along the axis of the plunger 520, a plunger housing 572 can be employed. The plunger housing 572 can be situated within a plunger port 576 defined by the pump body 508, and the housing 572 can define a bore (which, in some cases, can have a generally circular cross section and therefore can be generally cylindrical in shape), similar in some ways to the housing discussed above with respect to FIGS. 3A and 3B. In accordance with certain embodiments, the plunger portion 520 (and/or the entire piston-plunger 516), as well as the plunger housing 572, can be constructed from a ceramic material, including without limitation the materials discussed in detail above. The plunger 520 can be designed to be slidably disposed within the plunger housing, to within a clearance (i.e., tolerance) of a few microns. In certain embodiments, the clearance can be within about 0.6 microns per side (1.2 microns total) to about 1.5 microns per side (3.0 microns total). In this way, the plunger housing 572 can provide sealing capabilities to prevent leakage of any significant amount of pumped material without the need for any additional packing material, reducing the cost and complexity of maintenance. Moreover, certain embodiments eliminate the need for any sort of lubricating agents, often used in the past to reduce friction between the plunger and any associated packing materials, although in certain embodiments, lubricating agents still can be used if desired.

In some embodiments, the plunger housing 572 optionally can be placed under compression by the plunger port 576. This compression can be achieved, in some cases, by heating the plunger port 576 prior to inserting the plunger housing 572 into the plunger port 576. Other embodiments secure the plunger housing using other means, for instance through use of an adhesive and/or other insert, press fitting, capping and the like. For instance, in an embodiment where the pump body 508 is attached to the power head 504 using a threaded attachment method (e.g., 522), the plunger port 576 can be integrated into the threaded portion of the pump body 508, and attaching the pump body 508 to the threaded attachment 522 can operated to place the plunger port 576, and by extension, the plunger housing 572, under compression. Regardless of the method of compressing the plunger housing 572, however, those skilled in the art will recognize that the compression of housing 572 can, in some cases, operate to reduce the clearance between the housing 572 and the plunger 520. In such cases, the housing 572 and/or plunger 520 can be designed to accommodate changes to the interior diameter of the plunger housing anticipated as a result of the compression of the housing 572.

As discussed above, the length of the plunger housing 572 can affect the sealing performance of the housing, and various embodiments of the invention therefore can employ plunger housings of varying lengths, depending on anticipated pressures within the pump chamber 536. In particular embodiments, the design of the plunger housing 572 (e.g., the housing's length, the clearance between the housing and the plunger, etc.) can take into account the presence and/or threshold pressure of a bleeder valve (e.g., 548), which can be used to determine the maximum anticipated pressure within the pump chamber 536, as well as the type of material to be pumped.

As alluded to above, in certain cases it can be helpful to have as close a fit as possible between the plunger port 576 and the plunger housing 572. Ceramic materials can be used to obtain such a precise fit. In accordance with certain embodiments of the invention, therefore, a method is provided for producing a ceramic plunger pump assembly. In some embodiments, methods for producing plunger pump assemblies can be used to create new pumps and/or injector heads, and, in particular, can be used to produce injector heads for any of the variety of "Texsteam™"-style pumps known in the art. In other embodiments, similar methods can be used to retrofit existing injector heads, pump bodies, etc. in order to accommodate ceramic plungers and/or plunger housings in accordance with various embodiments. For instance, the FloMore™ Series 5200 injector head, commercially available from Richart Distributors Inc. of Oklahoma City, Okla., could be retrofit in accordance with some embodiments of the invention. Similarly, the Series 5100 air or gas driven injectors from Texsteam Corporation™ of Houston, Tex. can be retrofit in accordance with other embodiments of the invention, and the Model 40/60/80 D-Series of pumps commercially available from Sidewinder Pumps, Inc.™ of Lafayette, La., can be retrofit according to certain embodiments of the invention.

Figure 6:
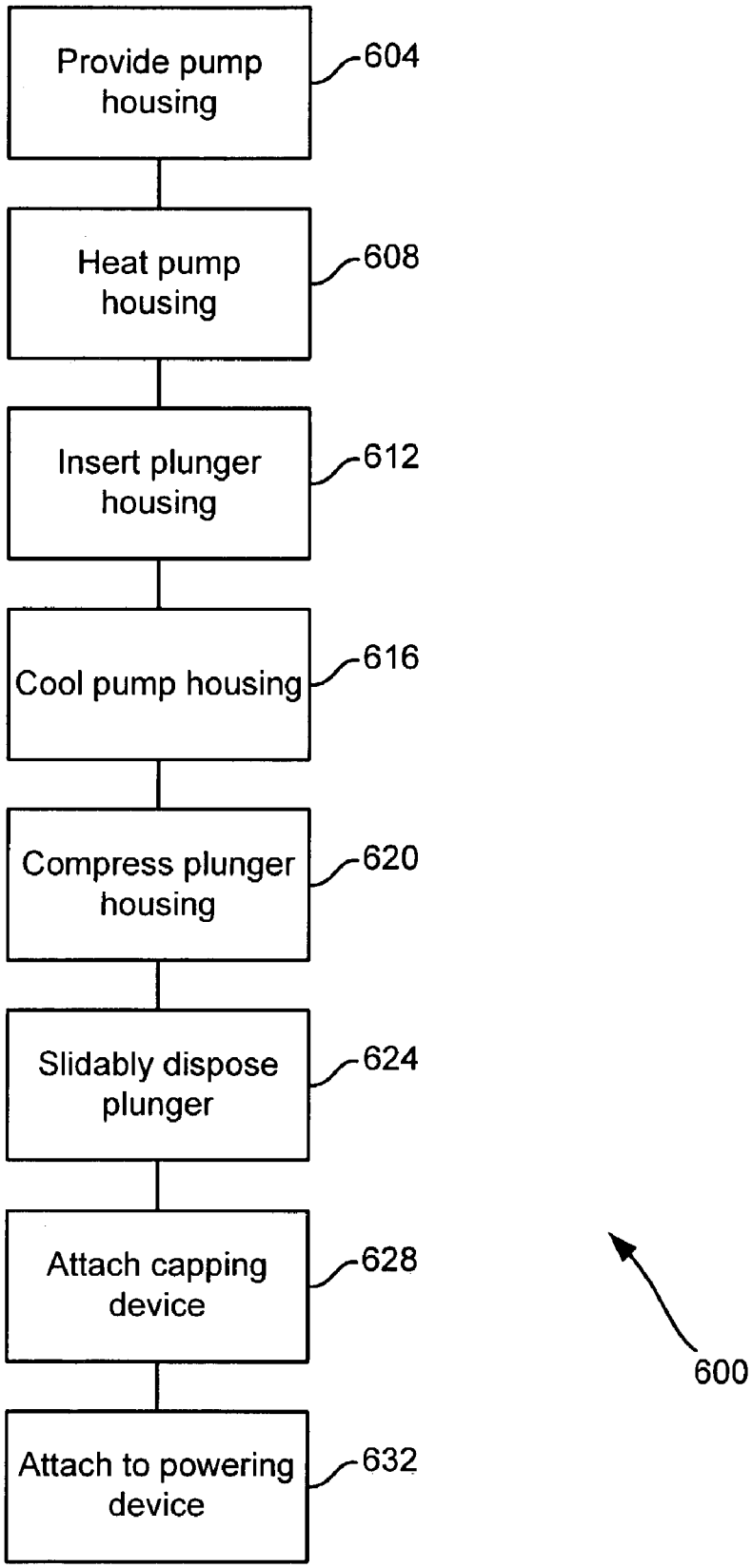
FIG. 6 is a process flow diagram illustrating a method that can be used to produce a pump assembly in accordance with various embodiments of the invention.

FIG. 6 illustrates an exemplary method 600 for producing a ceramic plunger pump assembly in accordance with embodiments of the invention. According to method 600, a pump body is provided at block 604. The body can be, merely by way of example, the pump body 200 of FIG. 2. At block 608, the pump body optionally can be heated from an ambient temperature to a temperature sufficient to cause expansion of the pump body, and, in particular, expansion of the plunger port. Those skilled in the art will recognize that the temperature to which the pump body ideally should be heated can vary according to the material from which the pump body is constructed. In a particular embodiment, a temperature in the range of about 200° F. to about 700° F., can cause sufficient expansion of the plunger port. In other embodiments a temperature in the range of about 300° F. to about 500° F. might be more suitable. In still other embodiments, a different temperature and/or range of temperatures may produce the best results. Those skilled in the art will recognize that, if desired, only that portion of pump body 200 that defines plunger port 244 need be heated.

Those skilled in the art also will recognize that heating the pump body can be accomplished by a variety of methods. For instance, a portable acetylene torch can be used to heat the portion of the pump body local to the plunger port. In other embodiments, the entire pump body might be heated in an oven. In still other embodiments, an exothermic chemical reaction could be used to apply heat to a specific portion of the pump body, and/or an induction coil might be used to heat a specific portion of the body. Any suitable method of heating the pump body can be employed without varying from the scope of the invention.

At block 612, a plunger housing (e.g., 248) can be inserted into the plunger port of the pump body. In accordance with some embodiments, the insertion procedure can be as simple as sliding the plunger housing into the plunger port. In other embodiments, the plunger housing and/or the plunger port can be threaded and/or otherwise adapted to be mated together, and insertion can comprise threading the housing into the port, etc. In a particular embodiment, the plunger port might employ a ridge or other positive fastening mechanism, and inserting the plunger housing can involve ensuring that the positive fastening mechanism has been engaged (i.e., inserting the plunger housing until it "clicks" into proper position).

Optionally, in accordance with certain embodiments, the pump body can be allowed to cool (block 616). If, for example, the pump body had been heated above the ambient temperature before the plunger housing was inserted, allowing the pump body to cool after insertion can cause the pump body to contract, producing a tighter seal between the plunger port and the plunger housing than might otherwise be obtained. In some cases, depending on the relative sizes of the plunger port and the plunger housing, cooling the pump body can effectively place the plunger housing under compression (block 620). Placing the plunger housing under compression not only can improve the seal between the plunger port and the plunger housing, but it also can greatly improve the burst strength of the of plunger housing, allowing it to withstand, for example, greater fluid pressures in the pump chamber. In effect, the tensile strength of the (often metallic) pump body and the compressive strength of the plunger housing can compliment one another, allowing for improved overall durability of the pump.

As discussed above, in accordance with certain embodiments, compressing the plunger housing can, in fact, reduce the size of the bore defined by the plunger housing, thereby reducing the clearance between the plunger housing and a plunger slidably disposed within the plunger housing. Hence, the manufacturing process of the plunger and/or plunger housing can account for this compression, and/or the design the plunger and/or plunger housing can be altered to incorporate marginally more clearance than otherwise would be desired.

At block 624, a plunger can be slidably disposed within the plunger housing in a fashion such that it can be moved into a pump chamber to perform the functions outlined above. Optionally, a capping device (such as the cap 252, illustrated on FIG. 2) can be attached to the plunger port to secure the plunger housing within the plunger port and/or to provide a means of attachment of the pump assembly to, for instance, a diaphragm motor. At block 632, the injector head can be attached to a powering device, for example, the drive system 108 of FIG. 1, which can be used to reciprocate the plunger and effectuate the pumping action described above.

In accordance with some embodiments of the invention, a plunger can be manufactured to have one or more discontinuities along the outer surface of the length of the plunger. These discontinuities can be filled with a packing material (e.g., a viscous fluid such as oil) before and/or during operation of the pump in order to provide a further seal against leakage of the material being pumped. For instance, in some cases, (e.g., where a relatively viscous material is being pumped), the discontinuities might be left empty prior to operation of the pump, and any pumped material leaking along the length of the plunger can fill the discontinuities, thereby effectively providing a seal again further leakage along the length of the plunger.

In other cases (e.g., where the pumped material has a relatively low viscosity), the discontinuities can be filled with a relatively more viscous packing fluid and/or lubricant prior to operation of the pump. This packing fluid/lubricant effectively can serve as a seal to block leakage of the pumped material along the length of the plunger. In either case, the material filling a discontinuity in the surface of the plunger can occupy the discontinuity as well, perhaps, as the clearance (i.e., the tolerance) between the plunger and the housing. In accordance with some embodiments of the invention, therefore, the discontinuities can be disposed on a portion of the plunger that remains within the housing during the entire stroke of the plunger, such that any material disposed within the discontinuities can maintain contact with the housing, whether the plunger is extended into the pump chamber or withdrawn from the pump chamber. In alternative embodiments, the housing itself might comprises similar discontinuities on the surface of the bore, and the plunger itself might have no discontinuities.

As mentioned above, the discontinuities are optional; in many embodiments, the plunger has no discontinuities. Moreover, the number of and nature of the discontinuities is discretionary and can vary by application. Implementations with a higher tendency for leakage (e.g., those with a relatively short housing and/or a relatively large clearance between the plunger and the housing, as well as those in which a relatively low viscosity fluid is pumped at relatively high pressures, as illustrated by FIGS. 4A and 4B) might have more discontinuities than other implementations. Likewise, the discontinuities can have any of a variety of cross-sectional profiles, some of which may be more appropriate under certain circumstances than others.

Figure 7A:
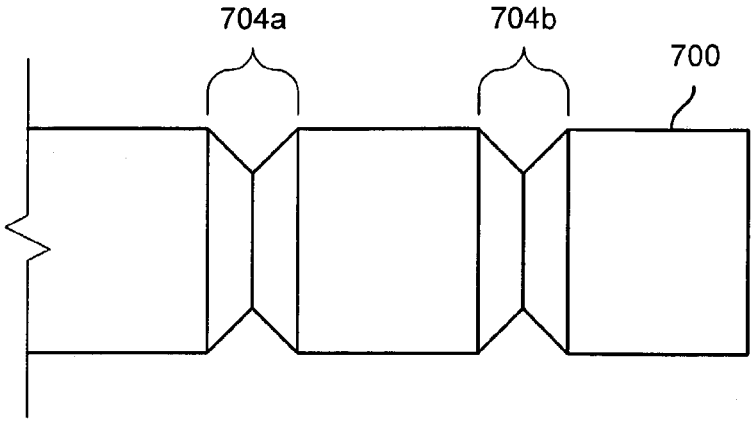
FIGS. 7A–7D illustrate plungers with surface discontinuities along their lengths, in accordance with various embodiments of the invention.
Figure 7B:
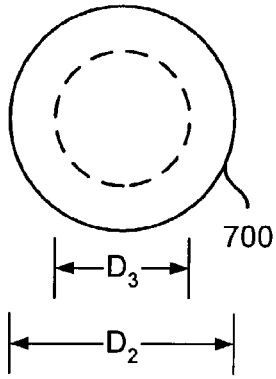
Figure 7C:
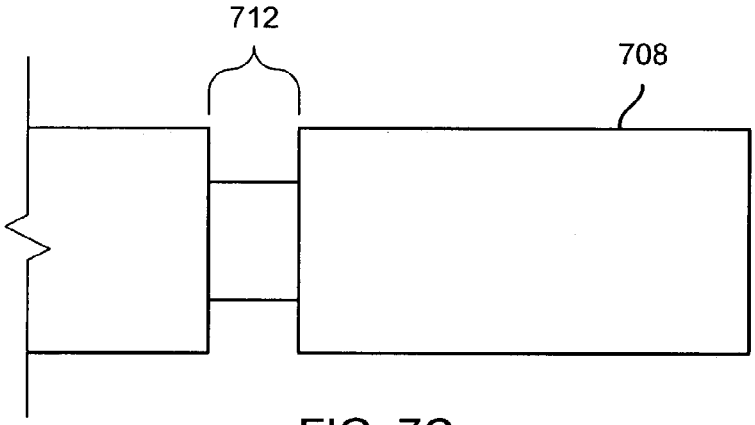
Figure 7D:
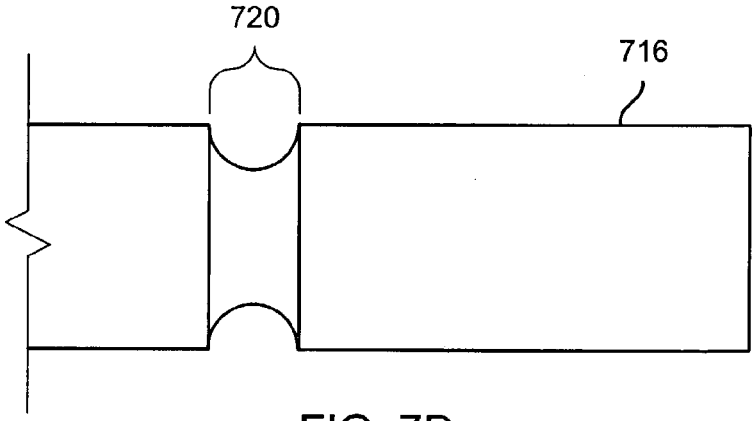

For example, FIG. 7A illustrates the side view of a plunger 700, which has been manufactured to incorporate discontinuities 704*a,* 704*b,* along the length of the plunger. In the embodiment illustrated by FIG. 7A, the discontinuities 704 have a profile that generally can be described as V-shaped, exhibiting a progressive narrowing of the circumference of the plunger from a larger outside diameter $D_2$ to a smaller diameter $D_3$ as illustrated on FIG. 7B. Those skilled in the art will recognize, however, that in other circumstances; different cross-sectional profiles may provide a more effective seal against excess leakage. For instance, FIG. 7C illustrates another plunger 708 having a single discontinuity 712 with a square cross-sectional profile, such that, along the length of the plunger 708, the discontinuity 712 represents an abrupt transition from an outside diameter $D_2$ to a narrower diameter $D_3$. Those skilled in the art will also recognize that in still other embodiments, discontinuities having different cross-sectional profiles may be utilized, which can be, merely by way of example, U-shaped and/or the like. The number of discontinuities is discretionary and can be varied in accordance with needs of particular implementations and/or as the result of empirical testing under various circumstances.

In accordance with further embodiments of the invention, the end of the plunger that is placed into the plump chamber can include a variety of different faces. For example, as in the embodiment illustrated by FIGS. 3A and 3B, a plunger can have a flat face that describes a perpendicular angle with the length of the plunger. In other embodiments, however, the face of the plunger can be convex, conical (i.e., pointed), etc. In still further embodiments, the face of the plunger can be concave, be notched and/or have any of a variety of cut-outs. In such embodiments, depending on the composition of the ceramic comprising the plunger, the variation in the face profile can allow for the deformation of part of the plunger, which, in some cases can serve to reduce the tolerance between the end of the plunger and the housing when substantial fluid pressure is applied to the face of the plunger (as during pumping operations). Deformation of the plunger in this way can, therefore, further reduce the amount of leakage of the pumped material along the length of the plunger.

Figure 8A:
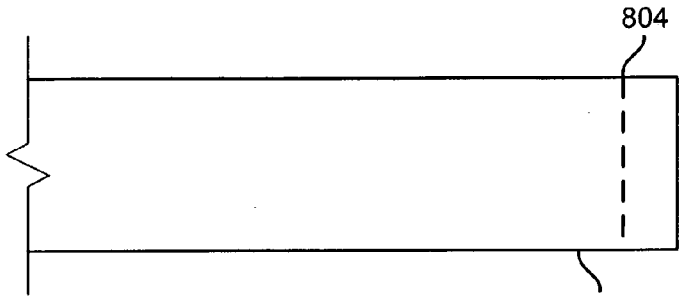
FIGS. 8A–8J illustrate plungers having a variety of facial profiles, in accordance with various embodiments of the invention.
Figure 8B:
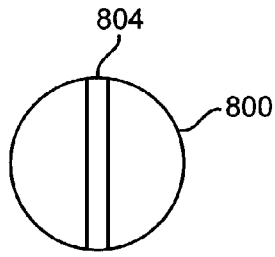

FIGS. 8A–8J illustrate several embodiments of plungers having faces of varied plunger face configurations, each of which can, in certain circumstances, allow for deformation of the end of the plunger. For example, FIG. 8A illustrates a plunger 800 including a notch 804. A cross-sectional view of the plunger 800 and notch 804 is provided in FIG. 8B. In this exemplary embodiment, a high fluid pressure applied to the face of plunger 800 (and, necessarily, to the surfaces of notch 804 as well) can force either side of the plunger 800 to deform away from the notch 804 effectively increasing the cross-sectional diameter of the plunger 800 and thereby reducing the tolerance between the plunger and the housing.

Figure 8C:
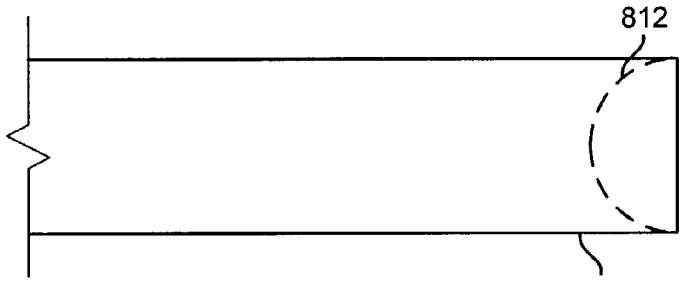
Figure 8D:
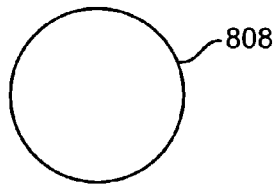
Figure 8E:
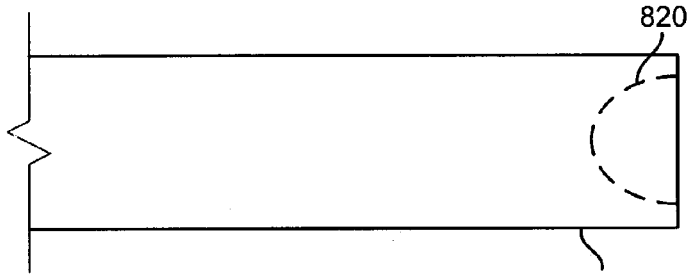
Figure 8F:
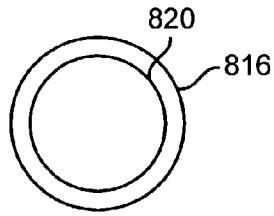
Figure 8G:
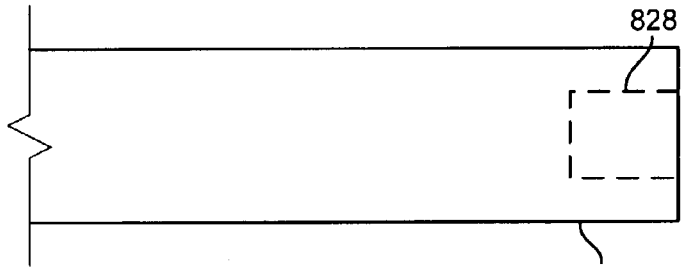
Figure 8H:
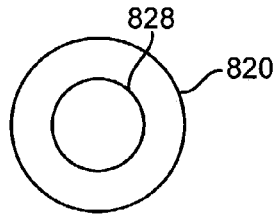
Figure 8I:
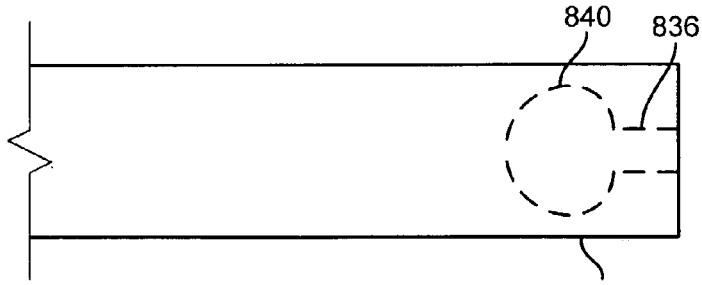
Figure 8J:
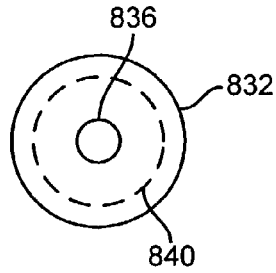

In still other embodiments, for example, those illustrated in FIGS. 8C and 8D, a plunger 808 can have a generally concave face 812. Again, fluid pressure against face 812 can force the enlargement of the cross-sectional diameter of the end of the plunger, effectively decreasing the tolerance between the plunger and the housing. FIGS. 8E and 8G illustrate plungers (816, 824, respectively), having face profiles (820, 828, respectively), that likewise can allow for deformation of the end of the plunger in accordance with certain embodiments of the invention. In particular embodiments, (for example, the embodiment illustrated by FIGS. 8I and 8J) a plunger 832 can have with a "keyhole" cutout, such that the face of the plunger includes a relatively narrow opening 836 that widens as it extends into the plunger 832 to describe a relatively larger void 840 within the plunger. Such embodiments can be used to cause deformation along a greater length of the end of plunger 832 and can be varied as desired to accomplish the intended deformation profile of the plunger 832.

Those skilled in the art will recognize that embodiments of the invention can include any of the face profiles described above, as well as others. The choice of face profile can depend on the fluid pressure exhibited by the material being pumped as well as other qualities of the fluid and/or plunger, e.g., viscosity and/or Reynolds numbers of the fluid, length of the plunger housing, tolerance between plunger and the housing, etc., as such characteristics are described above.

In this way, embodiments of the invention provide pump assemblies and methods for producing them. The description above identifies certain exemplary embodiments for implementing the invention, but those skilled in the art will recognize that many modifications and variations are possible within the scope of the invention. Therefore, the invention is defined only by the claims set forth below.

What is claimed is:

1. A ceramic plunger pump assembly, comprising:

a pump body defining a pump chamber with an inlet port and an outlet port, wherein the pump body further defines a plunger port disposed between the inlet port and the outlet port;

a first check valve in fluid communication with the inlet port of the pump chamber, wherein the first check valve is configured to allow a fluid to flow only into the pump chamber;

a second check valve in fluid communication with the outlet port of the pump chamber, wherein the second check valve is configured to allow the fluid to flow only out of the pump chamber;

a ceramic plunger housing defining a cylindrical bore having an interior diameter, wherein the plunger housing is disposed within the plunger port; and a ceramic plunger having an exterior diameter, wherein the ceramic plunger is slidably disposed within the cylindrical bore such that when the ceramic plunger is reciprocated back and forth within the bore, the fluid is moved from the inlet port of the pump chamber to the outlet port of the pump chamber, and wherein the exterior diameter of the ceramic plunger fits the interior diameter of the bore to within a tolerance of about 1.0 microns to about 6.0 microns.

2. The ceramic plunger pump assembly of claim 1, wherein the tolerance is configured generally to prevent the fluid from escaping the pump chamber through the bore.

3. The ceramic plunger pump assembly of claim 1, wherein the tolerance is in the range from about 1.47 microns to about 2.45 microns.

4. The ceramic plunger pump assembly of claim 1, wherein the length of the plunger housing is in the range from about 0.5 centimeters to about 10.0 centimeters.

5. The ceramic plunger pump assembly of claim 1, wherein the plunger housing comprises a toughened alumina.

6. The ceramic plunger pump assembly of claim 1, wherein the plunger housing comprises a transformation-toughened zirconia.

7. The ceramic plunger pump assembly of claim 1, wherein the plunger housing comprises approximately 99.5 percent $Al_2O_3$.

8. The ceramic plunger pump assembly of claim 1, wherein the ceramic plunger comprises a toughened aluminum oxide.

9. The ceramic plunger pump assembly of claim 1, wherein the plunger comprises a transformation-toughened zirconia.

10. The ceramic plunger pump assembly of claim 1, wherein the ceramic plunger comprises approximately 99.5 percent $Al_2O_3$.

11. The ceramic plunger pump assembly of claim 1, wherein the fluid is a liquid.

12. The ceramic plunger pump assembly of claim 1, wherein the fluid is a gas.

13. The ceramic plunger pump assembly of claim 1, wherein the face of the plunger defines a profile which deforms when the plunger is reciprocated and reduces the tolerance between the plunger and the bore.

14. The ceramic plunger pump assembly of claim 13, wherein the profile comprises a selection from the group consisting of:

a notch;

a concave cavity;

a cylindrical cavity; and a keyhole shape cavity.

15. A ceramic plunger pump assembly, comprising:

a pump body defining a pump chamber with an inlet port and an outlet port, wherein the pump body further defines a plunger port disposed between the inlet port and the outlet port;

a first check valve in fluid communication with the inlet port of the pump chamber, wherein the first check valve is configured to allow a fluid to flow only into the pump chamber;

a second check valve in fluid communication with the outlet port of the pump chamber, wherein the second check valve is configured to allow the fluid to flow only out of the pump chamber;

a ceramic plunger housing defining a cylindrical bore having an interior diameter, wherein the plunger housing is disposed within the plunger port; and a ceramic plunger having an exterior diameter, wherein the ceramic plunger is slidably disposed within the cylindrical bore such that when the ceramic plunger is reciprocated back and forth within the bore, the fluid is moved from the inlet port of the pump chamber to the outlet port of the pump chamber, and wherein a surface of the plunger defines at least one discontinuity, and wherein the discontinuity is configured to reduce the escape of the fluid though the bore.

16. The ceramic plunger pump assembly of claim 15, wherein the exterior diameter of the ceramic plunger fits the interior diameter of the bore to within a certain tolerance.

17. The ceramic plunger pump assembly of claim 16, wherein the certain tolerance is configured generally to prevent the fluid from escaping the pump chamber through the bore.

18. The ceramic plunger pump assembly of claim 16, wherein the certain tolerance is in the range from about 1.0 microns to about 6.0 microns.

19. The ceramic plunger pump assembly of claim 16, wherein the certain tolerance is in the range from about 1.47 microns to about 2.45 microns.

20. The ceramic plunger pump assembly of claim 15, wherein a surface of the plunger defines at least one discontinuity, and wherein the discontinuity is configured to reduce the escape of the fluid through the bore.

21. The ceramic plunger pump assembly of claim 20, wherein the profile comprises a selection from the group consisting of:

a notch;

a concave cavity;

a cylindrical cavity; and a keyhole shape cavity.

* * * * *